US006835702B2

(12) United States Patent
Herdt et al.

(10) Patent No.: US 6,835,702 B2
(45) Date of Patent: Dec. 28, 2004

(54) COMPOSITIONS AND METHODS FOR MITIGATING CORROSION OF APPLIED COLOR DESIGNS

(75) Inventors: Brandon Leon Herdt, Hastings, MN (US); Gerald Kurt Wichmann, Maple Grove, MN (US); David Arnold Halsrud, Minneapolis, MN (US); Michel Marie Lawrence, Inver Grove Heights, MN (US); Richard Eugene Steindorf, Big Lake, MN (US)

(73) Assignee: Ecolab Inc., St. Paul, MN (US)

( * ) Notice: Subject to any disclaimer, the term of this patent is extended or adjusted under 35 U.S.C. 154(b) by 302 days.

(21) Appl. No.: 10/007,491

(22) Filed: Nov. 7, 2001

(65) Prior Publication Data

US 2003/0050203 A1 Mar. 13, 2003

Related U.S. Application Data

(60) Provisional application No. 60/246,386, filed on Nov. 7, 2000, and provisional application No. 60/313,074, filed on Aug. 17, 2001.

(51) Int. Cl.[7] ..... C11D 1/94; C11D 3/30; C11D 3/36; C11D 3/06

(52) U.S. Cl. ..... 510/219; 510/222; 510/228; 510/229; 510/235; 510/237; 510/421; 510/433; 510/435; 510/436; 510/467

(58) Field of Search ..... 510/219, 222, 510/228, 229, 235, 237, 421, 433, 435, 436, 467

(56) References Cited

U.S. PATENT DOCUMENTS

| | | | | | |
|---|---|---|---|---|---|
| 4,070,309 | A | | 1/1978 | Jacobsen | |
| 4,105,573 | A | | 8/1978 | Jacobsen | |
| 4,420,578 | A | | 12/1983 | Hagens et al. | |
| 5,039,441 | A | * | 8/1991 | Thomas et al. | 510/238 |
| 5,066,415 | A | | 11/1991 | Dany et al. | |
| 5,597,789 | A | | 1/1997 | Sadlowski | |
| 5,767,056 | A | | 6/1998 | Lenoir | |
| 5,770,555 | A | * | 6/1998 | Weinstein | 510/434 |
| 5,849,095 | A | | 12/1998 | Rouillard | |
| 5,998,358 | A | * | 12/1999 | Herdt et al. | 510/506 |
| 6,034,048 | A | | 3/2000 | Talley | |
| 6,063,289 | A | | 5/2000 | Failon et al. | |
| 6,063,290 | A | | 5/2000 | Failon et al. | |
| 6,106,633 | A | | 8/2000 | Rouillard | |
| 6,121,219 | A | * | 9/2000 | Herdt et al. | 510/218 |
| 6,247,478 | B1 | * | 6/2001 | Cords et al. | 134/22.1 |
| 6,554,005 | B1 | * | 4/2003 | Cords et al. | 134/22.1 |
| 6,569,261 | B1 | * | 5/2003 | Aubay et al. | 134/39 |

FOREIGN PATENT DOCUMENTS

| | | |
|---|---|---|
| CA | 2176336 | 3/2001 |
| DE | 27 45 084 | 4/1979 |
| EP | 0 844 301 A2 | 5/1998 |
| EP | 1 253 192 | 10/2002 |
| WO | WO 94/25556 | 11/1994 |
| WO | WO 98/30662 | 7/1998 |
| WO | WO 00/06361 A1 | 2/2000 |
| WO | WO 01/11003 | 2/2001 |
| WO | WO 01/12769 A1 | 2/2001 |

OTHER PUBLICATIONS

Antol, P., "Cleaning of Applied Ceramic Labeling", *Sopheon/Teltech Research Services*,pp. 5–18 (Oct. 25, 2000).

* cited by examiner

*Primary Examiner*—Gregory R Del Cotto
(74) *Attorney, Agent, or Firm*—Merchant & Gould P.C.

(57) ABSTRACT

The present invention relates to compositions and methods for mitigating corrosion of applied color designs on a bottle, or on another glass or ceramic item. More specifically the composition or method of the present invention can mitigate corrosion even in the presence of a known corrosive agent. The composition and methods of the invention employ one or more phosphates and one or more phosphonates at a ratio that reduces or minimizes corrosion of an applied color design.

39 Claims, 3 Drawing Sheets

Figure 2: (Y:Pixel Frequency; X:Grey Scale Depth)
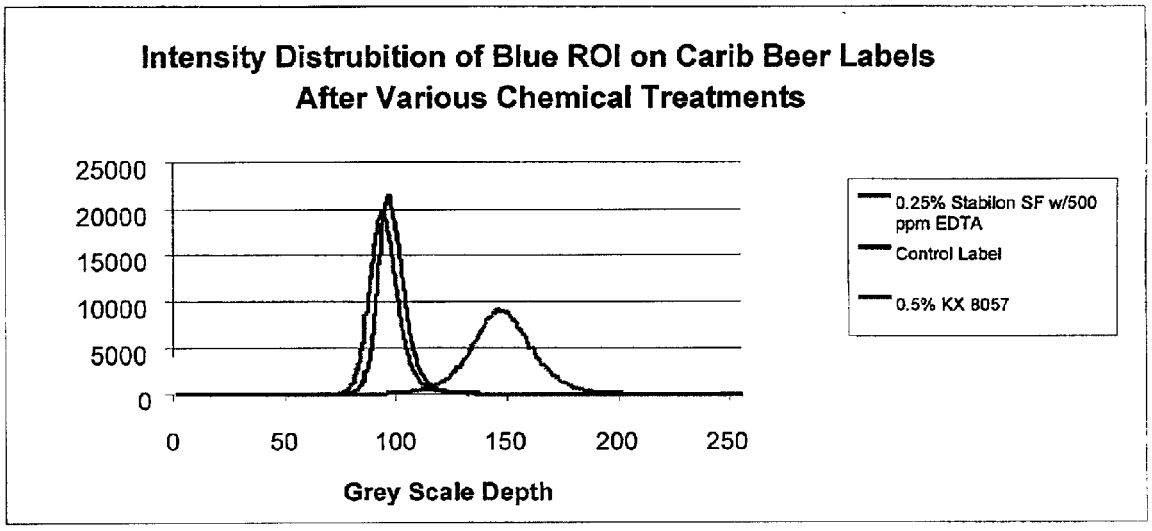
Figure 3:
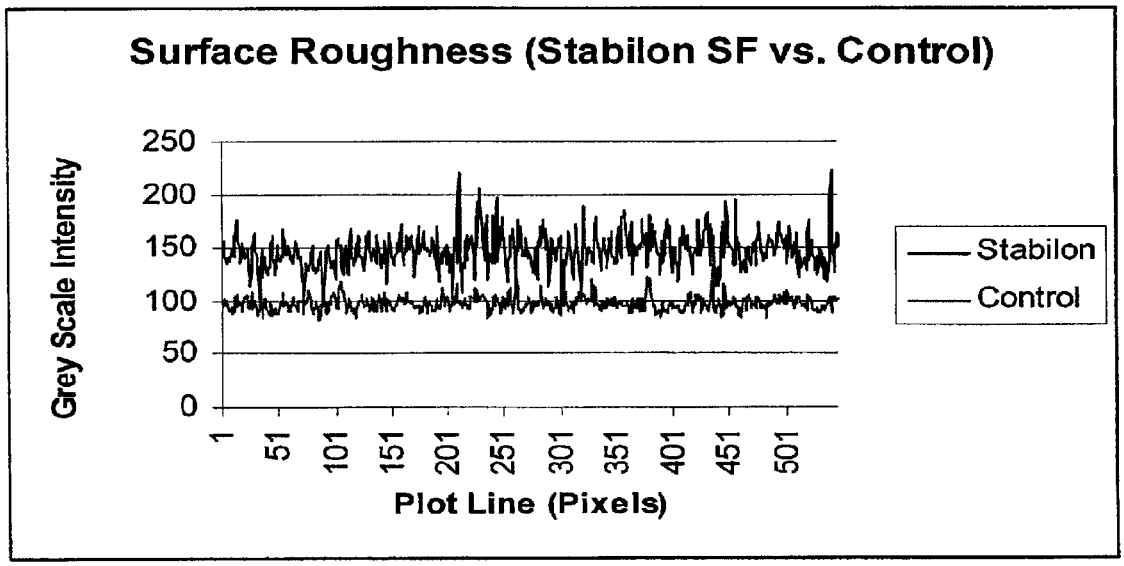

COMPOSITIONS AND METHODS FOR MITIGATING CORROSION OF APPLIED COLOR DESIGNS

CROSS REFERENCE TO RELATED APPLICATIONS

This application claims priority to U.S. Provisional Patent Application Ser. Nos. 60/246,386, filed Nov. 7, 2000, and 60/313,074, filed Aug. 17, 2001, the disclosures of which are incorporated herein by reference.

FIELD OF THE INVENTION

The present invention relates to compositions and methods for mitigating corrosion of applied color designs on a bottle, or on another glass or ceramic item. More specifically the composition or method of the present invention can mitigate corrosion even in the presence of a known corrosive agent. The composition and methods of the invention employ one or more phosphates and one or more phosphonates at a ratio that reduces or minimizes corrosion of an applied color design.

BACKGROUND OF THE INVENTION

Many beverages sold outside North America come in reusable glass bottles. By current estimates, annual worldwide production amounts to five billion reusable glass bottles. Many of these reusable glass bottles include an applied color label (ACL). An ACL is typically burned into the glass at the time of manufacture of the bottle. These labels are designed to be permanent for the useful life of the bottle.

Reuse of a glass bottle with ACL requires that the bottle and label remain aesthetically appealing for the duration of their life cycle. Currently, ceramic colors present the most commercially viable method of producing a label that will withstand up to 50 reuses. Several companies have described non-ceramic (resin/polymer or organic) based systems, but none these systems have yet achieved suitable durability. This lack of durability is quite understandable in light of the effect on the label of hot alkaline bottle washing processes. The cleaners used in bottle washing processes are designed to be aggressive on soils, but can also attack the ACL, either organic or ceramic, causing deterioration and shortening the useful life of the label.

Label deterioration is undesirable because of the negative impact it has on brand image, consumer appeal and quality of the beverage package. When the ACLs themselves appear 'washed out' and bled, they are no longer aesthetically appealing, forcing the bottles to be discarded before the end of their useful lives.

Therefore, there remains a need for a bottle washing composition that minimizes attack on ACLs on glass bottles, while still providing adequate soil removal.

SUMMARY OF THE INVENTION

The present invention relates to the realization that a caustic cleaning composition can be formed which significantly reduces or prevents deterioration or corrosion of an applied color design, such as an applied ceramic or applied color label, during cleaning operations, such as bottle washing. More specifically, the present invention is premised upon the realization that a highly caustic cleaning composition can be formed from materials that contain both phosphates and phosphonates, known corrosive agents, providing effective cleaning properties while maintaining design or label integrity.

The present compositions and methods can also include one or more of a suitable alkalinity source, such as sodium hydroxide or sodium carbonate; a builder, including those that are phosphorus-based; a sequestering agent, which can be a phosphonate; and an organic builder, such as gluconic acid, lactic acid, citric acid, salts of these acids, or combination thereof. The listed ingredients are but examples of suitable ingredients, and other suitable ingredients can be employed. The present methods and compositions can include surfactants such as alcohol ethoxylates, polyoxyetheylene coco amines, EO-PO block copolymers, and capped alcohol ethoxylates. Other surfactants may also be used.

Employing this chemistry provides an effective cleaning composition that mitigates damage to the permanent applied ceramic designs or labels. Employing this chemistry also provides useful methods and compositions for washing bottles that mitigates damage to the permanent applied ceramic labels. These cleaning compositions and methods prolong the usable life of the bottle or other ceramic ware and contribute to the consumer perception of positive brand image.

BRIEF DESCRIPTION OF THE PREFERRED EMBODIMENT

FIG. 2 illustrates the intensity distribution (color intensity) for applied color labels on bottles after various chemical treatments.

FIG. 3 illustrates the surface roughness for an applied color label of a bottle washed with a conventional bottle wash composition compared to a control bottle.

DETAILED DESCRIPTION OF THE PREFERRED EMBODIMENT

Definitions

Figure 1:
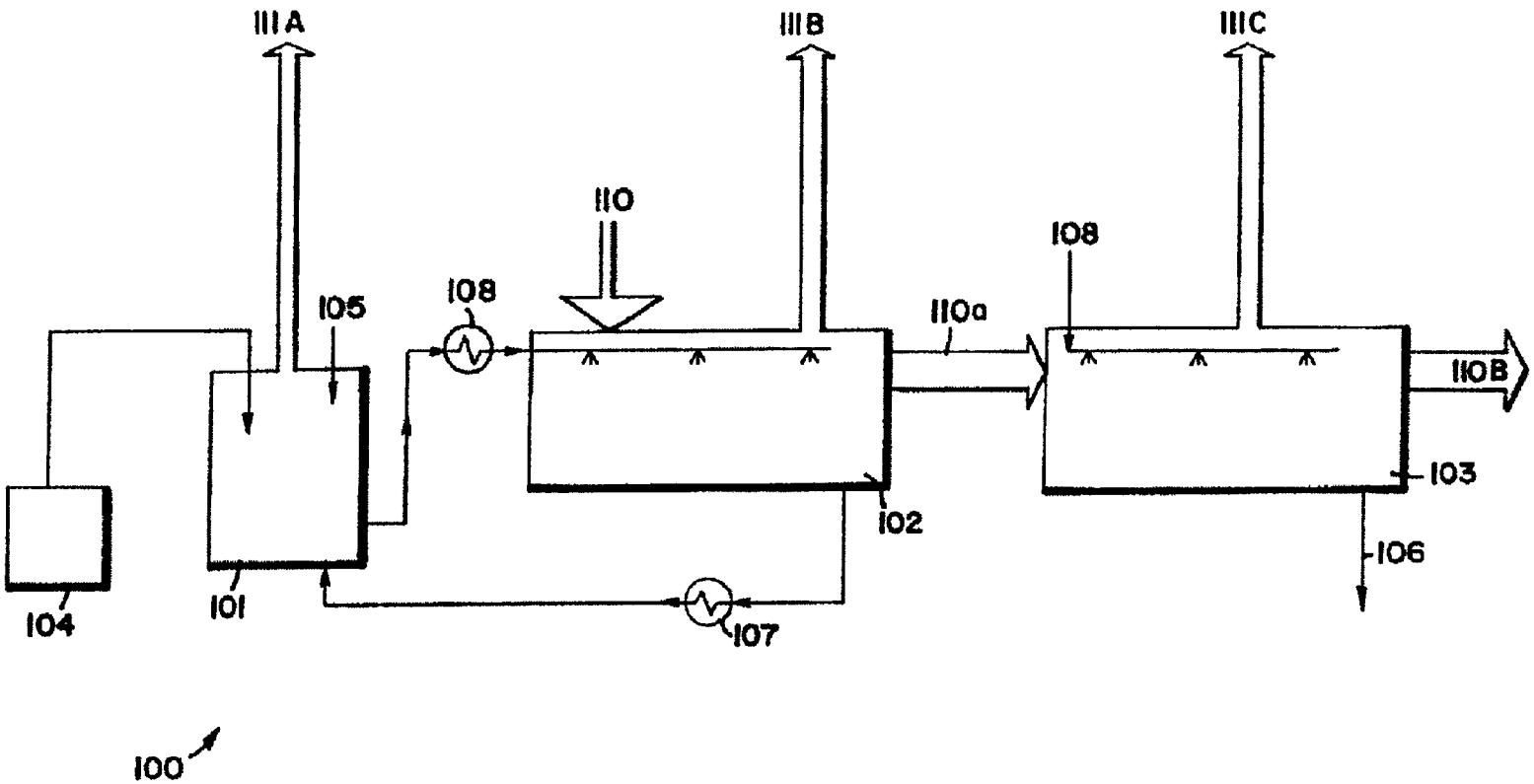
FIG. 1 is a diagram of a beverage plant, including a cold aseptic filling plant, in which either carbonated or non-carbonated beverages can be prepared and bottled.

As used herein, the phrase "applied color design" refers to a design, decoration, decorative element, or label that is applied in a fashion which is intended to be permanent while glass or ceramic ware (e.g. a bottle) is in circulation, use, and/or reuse. An applied color design can be a ceramic applied color design, or a non-ceramic applied color design (e.g. an organic applied color design). Organic applied color designs include thermoplastic non-ceramic, organics combined with an electrostatically applied organic coating, and LTV curing non-ceramic. Applied ceramic designs include designs that are etched into the surface, embossed, or pigmented. Certain applied color designs can also be applied to plastic materials, such as polyethylene terephthalate materials.

One type of applied color design is referred to herein as an "applied color label" (ACL). An applied color label is a label that is applied in a fashion which is intended to be permanent while glass or ceramic ware (particularly a bottle) is in circulation, use, and/or reuse. An applied color label can be a ceramic applied color label, or a non-ceramic applied color label (e.g. an organic applied color label). Organic applied color labels include thermoplastic ACL non-ceramic, ACL organics combined with an electrostatically applied organic coating, and LTV curing non-ceramic ACL. Applied ceramic labels include labels that are etched into the glass, embossed, or pigmented. Some polyethylene terephthalate articles, such as bottles, also include applied color labels.

As used herein, the term "corrosion" refers to a degradation of an applied color design or label through loss of color, removal of the design material, roughening of the surface of the design, and the like. Corrosion in its several manifestations leads to a design or label that is no longer suitable for sale or use. Corrosion can lead to an unrecognizable label or design.

As used herein, the phrase "additive composition" refers to a composition designed to boost, enhance, or otherwise improve cleaning power of an alkaline or caustic (or other) composition employed for washing glass or ceramic ware having an applied color design. As used herein, the phrase, "cleaning composition" refers to a composition including the major sources of caustic and/or surfactant for a mixture used in washing glass or ceramic ware having an applied color design. The mixture of the cleaning composition and additive composition is referred to herein as a "mixed composition" or "complete composition". A use composition refers to the cleaning and/or additive composition diluted to the concentrations actually used for washing or soaking bottles. Upon dilution, a concentrate composition yields a use composition.

As used herein, the phrase "washing" refers to washing bottles or washing ceramic or glass objects having applied color designs or similar decorative elements. Washing includes both active spraying, scrubbing, or rinsing; and submersion or soaking in still or circulating fluid. Washing or cleaning includes washing or cleaning wares such as painted china or coffee cups, glass or decorated vitreous enamel (e.g. vitreous enamel pans), decorated china, and the like.

As used herein, the phrase "bottle washing additive" refers to a composition designed to boost, enhance, or otherwise improve cleaning power of an alkaline or caustic (or other) composition employed for bottle washing. The additive compositions of the present invention are suitable as bottle washing additives. As used herein, the phrase, "bottle washing composition" refers to a composition including the major sources of caustic and/or surfactant for a mixture used in bottle washing. The mixture of the bottle washing composition and bottle washing additive is referred to herein as a "complete bottle washing composition". A use composition refers to the bottle washing composition and/or the bottle washing additive diluted to the concentrations actually used for washing or soaking bottles. Upon dilution, a concentrate composition yields a use composition.

As used herein, the phrase "bottle washing" refers to washing bottles, but can also include washing ceramic or glass objects having applied color designs or similar decorative elements. Washing includes both active spraying, scrubbing, or rinsing; and submersion or soaking in still or circulating fluid.

As used herein, weight percent, percent by weight, % by weight, and the like are synonyms that refer to the concentration of a substance as the weight of that substance divided by the weight of the composition and multiplied by 100.

As used herein, basic or alkaline pH refers to pH greater than 7, preferably greater than 8 and up to about 14.

As used herein, the term "about" modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. Whether or not modified by the term "about", the claims include equivalents to the quantities.

Methods and Compositions for Mitigating Corrosion of Applied Color Designs

The present invention relates to additive and/or cleaning compositions that employ a phosphate and a phosphonate to provide cleaning or washing of glass or ceramic ware incorporating an applied color design without unacceptable corrosion of the design. The present invention also relates to methods of cleaning glass or ceramic ware employing such additive or cleaning compositions. In particular, the present use or concentrate additive or cleaning composition typically includes phosphate and phosphonate at a weight ratio of phosphate to phosphonate greater than about 0.05:1 (1:20) and less than about 3:1, preferably about 2:1, such as about 1.9:1. Such ratios can be achieved in a concentrate additive composition with a phosphate at a level above about 0.5 wt-% and a phosphonate at a level above about 0.25–0.35 wt-% and below about 80 wt-%. The present concentrate additive compositions are typically diluted by about 100-fold to about 1000-fold to form a use composition. Thus, a use composition according to the present invention typically contains a phosphate at a level above about 0.01 wt-% and a phosphonate at a level above about 0.005–0.007 wt-% and below about 0.2 wt-%.

An applied color design, particularly an applied color label, can withstand up to about 50–100 or more or more washings with an alkaline cleaning composition employing the present combinations of phosphate and phosphonate, compared to only about 5 to about 20 washings with a conventional cleaning composition with or without a conventional additive.

Suitable phosphates build a bottle washing composition and can provide soil dispersion, detergency, water hardness control, and the like to the present additive or cleaning composition. Such phosphates include a monomer of phosphoric acid, a polymer of phosphoric acid, a salt of phosphoric acid, or a combination thereof; an ortho phosphate, a meta phosphate, a tripolyphosphate, or a combination thereof; phosphoric acid; alkali metal, ammonium and alkanolammonium salts of polyphosphates (e.g. sodium tripolyphosphate and other higher linear and cyclic polyphosphate species, pyrophosphates, and glassy polymeric meta-phosphates); amino phosphates; nitrilotrismethylene phosphates; and the like; or a combination thereof. Preferred phosphates include phosphoric acid, and monomers, polymers, and salts thereof, and the like, or a combination thereof. The concentrate additive composition typically contains about 3 to about 30% by weight phosphate, preferably about 6 to about 15% by weight, preferably about 10% by weight.

Suitable phosphonates build and chelate in a bottle washing composition and can provide hardness control, detergency, rinseability, scale prevention, and the like to the present additive or cleaning composition. Such phosphonates include a wide variety of phosphonic acids and phosphonate salts, such as organophosphonates.

As used herein, organic phosphonate or organophosphonate refers to organic phosphonates lacking any amino or imino (e.g. nitrogen) moieties. The phosphonic acid or phosphonate can include a low molecular weight phosphonopolycarboxylic acid such as one having about 2–4 carboxylic acid moieties and about 1–3 phosphonic acid groups. Some examples of organic phosphonates include 1-hydroxyethane-1,1-diphosphonic acid: $CH_3C(OH)[PO(OH)_2]_2$; 1-phosphono-1-methylsuccinic acid, phosphonosuccinic acid; 2-phosphonobutane-1,2,4-tricarboxylic acid; other similar organic phosphonates; and mixtures thereof. Additional suitable phosphonates include phosphorus acid, $H_3PO_3$, and its salts. Although not limiting to the present invention, it is believed that the presence of one or more organic phosphonates provides at least part of mitigation of corrosion otherwise caused by phosphate or amino phosphonate.

As used herein, amino phosphonate refers to phosphonates including amino or imino (e.g. nitrogen) moieties. Although generally corrosive to glass and applied color designs, amino phosphonates can be employed in the compositions and methods of the present invention, and corrosion caused by the amino phosphonate can be mitigated. Such amino phosphonates include: ethylene diamine (tetramethylene phosphonates); nitrilotrismethylene phosphates; diethylenetriamine (pentamethylene phosphonates); aminotri(methylenephosphonic acid): $N[CH_2PO(OH)_2]_3$; aminotri(methylenephosphonate), sodium salt:

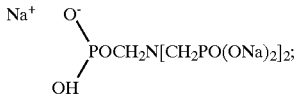

2-hydroxyethyliminobis(methylenephosphonic acid) $HOCH_2CH_2N[CH_2PO(OH)_2]_2$; diethylenetriaminepenta (methylenephosphonic acid) $(HO)_2POCH_2N[CH_2CH_2N[CH_2PO(OH)_2]_2]_2$; diethylenetriaminepenta (methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene)triamine(pentamethylenephosphonic acid) $(HO_2)POCH_2N[(CH_2)_6N[CH_2PO(OH)_2]_2]_2$. These amino phosphonates commonly contain alkyl or alkaline groups with less than 8 carbon atoms. Preferred amino phosphonates that can exhibit mitigated corrosion of glass or an applied color design include aminotri(methylenephosphonic acid), ($N[CH_2PO_3H_2]_3$), available from Monsanto as DEQUEST® 2000 and also available as Briquest 301-50A, and Amino Tri (Methylene Phosphonic Acid) 50%, low ammonia from Albright & Wilson; and their salts.

Phosphonic acids can be used in the form of water soluble acid salts, particularly the alkali metal salts, such as sodium or potassium; the ammonium salts; or the alkylol amine salts where the alkylol has 2 to 3 carbon atoms, such as mono-, di-, or triethanolamine salts. The phosphonic acid can be in the form of a liquid or powder alkali metal salt composition. If desired, mixtures of the individual phosphonic acids or their acid salts can also be used. A neutralized or alkaline phosphonate, or a combination of the phosphonate with an alkali source prior to being added into the mixture such that there is little or no heat or gas generated by a neutralization reaction when the phosphonate is added is preferred.

Preferred phosphonates include organic phosphonates. Preferred organic phosphonates include phosphono butane tricarboxylic acid (PBTC) (such as that sold under the trade name Bayhibit AM) and hydroxy ethylene diphosphonic acid (HEDP) (such as that sold under the trade name Dequest 2010), and the like, or a combination thereof. The concentrate additive composition contains about 2 to about 20% by weight phosphonate, preferably about 4.5 to about 10% by weight, preferably about 6 to about 7% by weight, preferably about 6.8% by weight.

If the present concentrate and cleaning compositions include an amino phosphonate, they preferably also include an organic phosphonate. Surprisingly, although amino phosphonates corrode glass and applied color design, a composition including both an amino phosphonate and an organic phosphonate exhibits mitigated corrosion of glass or applied color design. Such mitigation occurs even in the absence of phosphate. In particular, a composition including ATMP, amino(tri(methylenephosphonic acid)), (such as that sold under the trade name Dequest 2000) plus an organic phosphonate mitigated corrosion of glass and/or applied color design. Preferably the weight ratio of amino phosphonate to organic phosphonate is less than 4:1 (e.g. about 3.5:1); preferably less than 3:1 (e.g. about 2.3:1) or less than 2:1 (e.g. about 1.7:1 or 1.5:1); preferably about 1:1 (e.g. about 1.2:1 or 1.5:1).

Ratios of phosphate to phosphonate within a certain range provide mitigation of corrosion or wear to the applied color design. Ratios of phosphate to phosphonate of about 4:1 or greater (wt:wt) in a cleaning or additive composition did not provide effective mitigation of erosion or wear to the applied color design. A ratio of phosphate to phosphonate of about 1.9:1 in a cleaning or additive composition provides effective mitigation of corrosion or wear to the applied color design. The ratio of phosphate to phosphonate can be as low as about 0.05:1, about 0.1:1, about 0.2:1, about 0.3:1, about 0.4:1, about 0.5:1, about 0.6:1, about 0.7:1, about 0.8:1, about 0.9:1, about 1:1, about 1.1:1, about 1.2:1, about 1.3:1, about 1.4:1, about 1.5:1, about 1.6:1, about 1.7:1, about 1.8:1, or about 1.9:1. The ratio of phosphate to phosphonate can be as high as about 2:1, about 2.2:1, about 2.4:1, about 2.6:1, about 2.8:1, about 3:1, about 3.2:1, or about 3.4:1.

Mitigation of corrosion or wear to the applied color design or label can be monitored by known methods. For example, viewing the design can determine whether it retains sufficient color, texture, sharpness, and/or overall quality for a salable product. A scale for grading color, texture, sharpness, and/or overall quality can aid in such a determination. The present application describes below additional methods for evaluating corrosion of an applied color design.

An additive of the present invention can be employed in washing glass or ceramic ware (e.g. bottles) with applied color designs or labels to extend the useful life of the applied color design or label. For example, employing an additive of the present invention, an applied color design preferably retains salable quality for at least about 50, about 80, about 100, or more washings, preferably for more than about 75 washings.

In each embodiment, the present additive or cleaning composition can also contain other ingredients, such as water, a chelating agent, a builder, or a combination thereof. In a preferred embodiment, the composition includes one or more chelating or sequestering agents including the phosphonate, and the like. In a preferred embodiment, the composition also includes as builders 2 to 12 carbon mono or di carboxylic acids, such as gluconic acid, lactic acid, citric acid, and the like, or a combination thereof. In concentrate compositions according to the invention, the concentrations of each of the ingredients can vary over a range that will allow obtaining a use composition by a desired dilution. Preferably, gluconic acid is present at about 1.5 to about 20 wt-%. Preferably, lactic acid is present at about 1 to about 20 wt-%. Preferably, citric acid is present at about 1 to about 20 wt-%. In a more preferred embodiment, the concentrate additive or cleaning composition of the invention includes about 7 wt-% gluconic acid, about 8 wt-% phosphoric acid, about 4 wt-% HEDP, about 5 wt-% citric acid monohydrate, about 4 wt-% lactic acid, and about 1 wt-% PBTC.

In each embodiment, the present additive or cleaning composition can also contain one or more surfactants, such as an amphoteric surfactant, a nonionic surfactant, or a combination thereof. In one preferred embodiment, the additive or cleaning composition includes an amphoteric surfactant, such as a polyoxyethylene coco amine (e.g. such as those sold under the trade name BK 1057 or Chemeen C-12G). In one preferred embodiment, the additive or cleaning composition includes a nonionic surfactant, such as an alcohol ethoxylate or an EO-PO block copolymer. Preferred alcohol ethoxylates include that sold under the trade name Plurafac and designated RA-40 and a butyl capped alcohol ethoxylate (e.g. one sold under the trade name Dehypon LT-104). Preferred EO-PO block copolymers include those sold under trade names such as Genepol with the designation PN 30. Preferably an EO-PO block copolymer is present at about 1 to about 20 wt-%. Preferably, an alcohol ethoxylate is present at about 0.5 to about 10 wt-%. In a more preferred embodiment, the concentrate additive or cleaning composition of the invention includes about 7 wt-% gluconic acid, about 8 wt-% phosphoric acid, about 4 wt-% HEDP, about 5 wt-% citric acid monohydrate, about 4 wt-% lactic acid, about 1 wt-% PBTC, about 6 wt-% of an EO-PO block copolymer (e.g., Genepol PN 30), and about 2 wt-% of an alcohol ethoxylate (e.g., Plurafac RA-40).

In certain embodiments an additive or cleaning composition according to the present invention can include a source of alkalinity, such as hydroxide, carbonate, or a combination thereof. Preferred sources of hydroxide include sources of sodium hydroxide, such as soda ash. An alkaline concentrate composition for warewashing can include 50% or more of the source of alkalinity. Compositions with these high levels of the source of alkalinity can often include only somewhat diminished levels of components such as certain organic builders or certain phosphonates. For example, some phosphonates are soluble to only about 1.5 to about 2 wt-% and gluconic acid is soluble to only about 3 wt-% in the presence of 50% caustic. An additive composition can advantageously contain higher concentrations of components of limited solubility in highly alkaline cleaning compositions.

The present additive composition includes only levels of EDTA or NTA (in their acid and/or salt forms) insufficient to cause corrosion of the applied color design. Preferably, the present additive composition includes no added EDTA, e.g. EDTA is absent or is present due to amounts found in components of the additive composition. Preferably, the level of EDTA is less than about 150 ppm, preferably less than about 100 ppm, preferably less than about 50 ppm.

The inventive additive or cleaning composition can be a concentrate or a use composition. The present concentrate composition is typically employed at a concentration of about 0.25 wt-% to about 0.5 wt-% to make a use composition. However, the maximum amount that a concentrate composition can be diluted need be limited only by solubility or compatibility of its various components. Thus, a concentrate composition can be subjected to greater dilutions to form a use composition. Maximum dilution of a concentrate composition typically employs as little as about 0.01 wt-% to about 0.1 wt-% of the concentrate. Alternatively, the minimum concentration or dilution of a concentrate composition is typically limited only by transport and handling considerations. That is, the concentrate is typically concentrated to an extent that provides easy and economical transport and handling. For example, convenience typically dictates dilution of a concentrate composition to concentrations of less than about 1 or 2 wt-%.

Diluting the inventive additive concentrate composition with water, with a water and a concentrate bottle washing composition, or with a use bottle washing composition yields a composition suitable for using for washing bottles, glass or ceramic items having an applied color design. The additive composition can be used with various bottle washing compositions known to those of skill in the art. These include compositions employing sources of alkalinity and/or surfactants as cleaners. The present additive compositions are compatible with a wide variety of sources of alkalinity including carbonate, hydroxide (e.g. caustic soda or soda ash), their salts, combinations thereof, and the like. The present additive compositions are compatible with a wide variety of surfactants including amphoteric surfactants, nonionic surfactants, combinations thereof, and the like.

Bottle, Glass, and Ceramic Washing

The present invention encompasses bottle washing compositions including bottle washing additives, bottle washing detergents, bottle washing solutions, as well as the process of washing bottles. The present invention can be used in other types applications that benefit from the same protective properties provided. This can include any type of ware washing apparatus that may be used to clean glass of any type, dishes, china, etc, particularly if the glass or other ware includes an applied color design, label, or like decorative design. In one embodiment, a composition of the present invention can also be employed for washing polyethylene terephthalate bottles with applied color labels. The invention can also be used in consumer applications such as detergents and detergent systems. The nature of the invention also extends to situations where chemistry similar to that used in ACLs is utilized for different applications that may also require cleaning and/or degreasing in conjunction with protection, such as paint surfaces, etc.

A bottle washing apparatus will generally have a volume of water to which a bottle washing composition with or without a bottle washing additive are added. A bottle washing composition typically includes a built detergent and/or an alkalinity source. A use bottle washing mixture can include a caustic soda concentration of about 1 to about 6 wt-%. In addition to the caustic soda, a bottle washing composition typically includes a surfactant, preferably one that does not promote deterioration of an applied color design and in an amount effective to improve soil dispersion.

The bottle washing solution can be formed by adding the individual components separately to the water in the bottle washer, or all of the components can be combined in the desired proportions and added to the water. The bottle washing composition may include the caustic source or the caustic source can be purchased and charged in separately. Further, the bottle washing composition can be formulated as a liquid or a powder, or a solid.

In the method of the present invention, bottle washing includes contacting the bottle or other glass or ceramic ware with an applied color design or label with a bottle washing composition according to the present invention or including an additive composition according to the present invention. Such contacting can be accomplished using a spray device or soaking tank or vessel to intimately contact the inside of the bottle with the cleaning composition for sufficient period of time to clean the container without unacceptably degrading the applied color design.

The container is then emptied of the amount of cleaning composition used. After emptying, the container can then be commonly rinsed with potable water or sterilized water and again emptied. After rinsing, the container can be filled with the liquid beverage. The container is then sealed, capped or closed and then packed for shipment for ultimate sale.

FIG. 1 shows a schematic for an embodiment of a bottle spraying/bottling operation that can employ the method of the present invention. This figure shows a plant 100 that can sequentially contact beverage bottles with cleaning composition. In the figure, bottles 110 are passed through a cleaning tunnel 102. In the cleaning tunnel 102, the bottles can be contacted with the cleaning composition. The cleaned bottles 110*a* then pass through a rinsing tunnel 103 and emerge as cleaned rinsed bottles 110*b*.

In the process, bulk cleaning composition and, optionally, additive composition are added to a first holding tank 101. Commonly, the composition is maintained at a temperature of about 40–50° C. in such a tank. To obtain the effective use concentration of composition, make-up water 105 is combined with the concentrated cleaning and, optionally, additive composition into first tank 101. The composition can be passed through a heater 108 to reach an elevated temperature, e.g., about 40–85° C.

The cleaning composition is sprayed within cleaning tunnel 102 into and onto all surfaces of the bottle 110. An intimate contact between the composition and the bottle 110 is essential for cleaning to an adequate level. After contact with the composition and after dumping any excess composition from the bottles, the cleaned bottles 110 are then passed to a fresh water rinse tunnel 103. Fresh water 108 is provided from a fresh water make-up into a spray rinsing tunnel 103. Excess spray drains from rinsing tunnel 103 to drain 106. Within the tunnel 103, cleaned bottles 110*a* are thoroughly rinsed with fresh water. The complete removal of the cleaning composition from the bottles 110*a* is important for maintaining high quality of the beverage product. The rinsed and sanitized bottles 110*b* are then removed from the rinsing tunnel.

The day tank 101, the sterilizing tunnel 102 and the rinsing tunnel 103 are all respectively vented to wet scrubber or vent 111*a*, 111*b* or 111*c* to remove vapor or fumes from the system components. The cleaning composition that has been sprayed and drained from the bottles 110*a* accumulates in the bottom of the spray tunnel 102 and is then recycled through recycle line and heater 107 into the day tank 101.

The contact between the bottles and the cleaning composition is typically at a temperature of greater than about 70° C. Cleaning of beverage containers typically employs about 0.1 to about 0.6 wt-% additive or cleaning composition with a caustic concentration of about 1.5 to about 3.5 wt-%, temperature of about 65°–85° C., and a contact time of typically more than about 15 min.

Builder

Detergent builders can optionally be included in the additive compositions of the present invention for purposes including assisting in controlling mineral hardness. Inorganic as well as organic builders can be used. The level of builder can vary widely depending upon the end use of the composition and its desired physical form. Phosphate and phosphonate that can serve as builders are described herein above.

Suitable builders include non-phosphate builders. These can include phytic acid, silicates, alkali metal carbonates (e.g. carbonates, bicarbonates, and sesquicarbonates), sulphates, aluminosilicates, monomeric polycarboxylates, homo or copolymeric polycarboxylic acids or their salts in which the polycarboxylic acid includes at least two carboxylic radicals separated from each other by not more than two carbon atoms, citrates, succinates, and the like. Preferred builders include citrate builders, e.g., citric acid and soluble salts thereof, due to their ability to enhance detergency of a soap or detergent solution and their availability from renewable resources and their biodegradability. Other preferred builders are the known polyaspartic acids and salts and derivatives thereof. Polyacetals obtained by reaction of dialdehydes with polyol carboxylic acids containing 5 to 7 carbon atoms and at least three hydroxyl groups, for example as described in European patent application EP-A-0 280 223, are also suitable builders. Preferred polyacetals are obtained from dialdehydes, such as glyoxal, glutaraldehyde, terephthalaldehyde and mixtures thereof, and from polyol carboxylic acids, such as gluconic acid and/or glucoheptonic acid Polycarboxylate Builders Examples of low molecular weight polycarboxylates suitable as organic cobuilders include: $C_4$–$C_{20}$-di-, -tri- and -tetracarboxylic acids, such as succinic acid, propanetricarboxylic acid, butanetetracarboxylic acid, cyclopentanetetracarboxylic acid and alkyl- and alkenylsuccinic acids with $C_2$–$C_{16}$-alkyl- or -alkenyl radicals; $C_4$–$C_{20}$-hydroxy carboxylic acids, such as malic acid, tartaric acid, gluconic acid, glucaric acid, citric acid, lactobionic acid and sucrosemono-, -di- and -tricarboxylic acids; aminopolycarboxylates, such as nitrilotriacetic acid, methylglycinediacetic acid, alaninediacetic acid, ethylenediaminetetraacetic acid and serinediacetic acid. Examples of oligomeric or polymeric polycarboxylates suitable as organic co-builders are: oligomaleic acids as described, for example, in EP-A-451 508 and EP-A-396 303; co- and terpolymers of unsaturated $C_4$–$C_8$-dicarboxylic acids, possible co-monomers which may be present being monoethylenically unsaturated monomers from group (i) in amounts of up to 95% by weight, from group (ii) in amounts of up to 60% by weight, from group (iii) in amounts of up to 20% by weight. Examples of unsaturated $C_4$–$C_8$-dicarboxylic acids suitable in this case are maleic acid, fumaric acid, itaconic acid and citraconic acid. Maleic acid is preferred.

The group (i) includes monoethylenically unsaturated $C_3$–$C_8$-monocarboxylic acids, such as acrylic acid, methacrylic acid, crotonic acid and vinylacetic acid. Preferably employed from group (i) are acrylic acid and methacrylic acid. Group (ii) includes monoethylenically unsaturated $C_2$–$C_{22}$-olefins, vinyl alkyl ethers with $C_1$–$C_8$-alkyl groups, styrene, vinyl esters of $C_1$–$C_8$-carboxylic acids, (meth) acrylamide and vinylpyrrolidone. Preferably employed from group (ii) are $C_2$–$C_6$-olefins, vinyl alkyl ethers with $C_1$–$C_4$-alkyl groups, vinyl acetate and vinyl propionate. Group (iii) includes (meth)acrylic esters of $C_1$–$C_8$-alcohols, (meth) acrylnitrile, (meth)acrylamides of $C_1$–$C_8$-amines, N-vinylformamide and vinylimidazole.

If the polymers contain vinyl esters as monomers of group (ii) these can also be partially or completely hydrolyzed to vinyl alcohol structural units. Suitable co- and terpolymers are disclosed, for example, in U.S. Pat. No. 3,887,806 and DE-A 43 13 909.

Copolymers of dicarboxylic acids which are suitable and preferred as organic cobuilders are the following: copolymers of maleic acid and acrylic acid in the ratio of 10:90 to 95:5 by weight, particularly preferably those in the ratio of from 30:70 to 90:10 by weight, with molecular weights of from 10,000 to 150,000; terpolymers of maleic acid, acrylic acid and a vinyl ester of a $C_1$–$C_3$-carboxylic acid in the ratio of from 10 (maleic acid):90 (acrylic acid+vinyl ester) to 95

(maleic acid):5 (acrylic acid+vinyl ester) by weight, it being possible for the ratio of acrylic acid to vinyl ester to vary in the range from 20:80 to 80:20 by weight, and particularly preferably terpolymers of maleic acid, acrylic acid and vinyl acetate or vinyl propionate in the ratio of from 20 (maleic acid):80 (acrylic acid+vinyl ester) to 90 (maleic acid):10 (acrylic acid+vinyl ester) by weight, it being possible for the ratio of acrylic acid to the vinyl ester to vary in the range from 30:70 to 70:30 by weight; copolymers of maleic acid with $C_2$–$C_8$-olefins in the molar ratio from 40:60 to 80:20, with copolymers of maleic acid with ethylene, propylene or isobutene in the molar ratio 50:50 being particularly preferred.

Graft polymers of unsaturated carboxylic acids on low molecular weight carbohydrates or hydrogenated carbohydrates, see U.S. Pat. No. 5,227,446, DE-A-44 15 623, DE-A-43 13 909, are likewise suitable as organic cobuilders.

Suitable unsaturated carboxylic acids in this connection are, for example, maleic acid, fumaric acid, itaconic acid, citraconic acid, acrylic acid, methacrylic acid, crotonic acid and vinylacetic acid, and mixtures of acrylic acid and maleic acid, which are grafted on in amounts of from 40 to 95% of the weight of the component to be grafted.

It is additionally possible for up to 30% by weight, based on the component to be grafted, of other monoethylenically unsaturated monomers to be present for modification. Suitable modifying monomers are the abovementioned monomers of groups (ii) and (iii).

Suitable as grafting base are degraded polysaccharides, such as acidically or enzymatically degraded starches, inulins or cellulose, reduced (hydrogenated or reductively aminated) degraded polysaccharides, such as mannitol, sorbitol, aminosorbitol and glucamine, and polyalkylene glycols with molecular weights of up to 5,000 such as polyethylene glycols, ethylene oxide/propylene oxide or ethylene oxide/butylene oxide block copolymers, random ethylene oxide/propylene oxide or ethylene oxide/butylene oxide copolymers, alkoxylated mono- or polyhydric $C_1$–$C_{22}$-alcohols, see U.S. Pat. No. 4,746,456.

Preferably employed from this group are grafted degraded or degraded reduced starches and grafted polyethylene oxides, employing from 20 to 80% by weight of monomers, based on the grafting component, in the graft polymerization. A mixture of maleic acid and acrylic acid in the ratio of from 90:10 to 10:90 by weight is preferably employed for the grafting.

Polyglyoxylic acids suitable as organic cobuilders are described, for example, in EP-B-001 004, U.S. Pat. No. 5,399,286, DE-A-41 06 355 and EP-A-656 914. The end groups of the polyglyoxylic acids may have various structures.

Polyamidocarboxylic acids and modified polyamidocarboxylic acids suitable as organic cobuilders are disclosed, for example, in EP-A-454 126, EP-B-511 037, WO 94/01486 and EP-A-581 452.

Also preferably used as organic cobuilders are polyaspartic acid or cocondensates of aspartic acid with other amino acids, $C_4$–$C_{25}$-mono- or -dicarboxylic acids and/or $C_4$–$C_{25}$-mono- or -diamines. Polyaspartic acids prepared in phosphorus-containing acids and modified with $C_6$–$C_{22}$-mono- or -dicarboxylic acids or with $C_6$–$C_{22}$-mono- or -diamines are particularly preferably employed.

Condensation products of citric acid with hydroxy carboxylic acids or polyhydroxy compounds which are suitable as organic cobuilders are disclosed, for example, in WO 93/22362 and WO 92/16493. Carboxyl-containing condensates of this type normally have molecular weights of up to 10,000, preferably up to 5,000.

Surfactants

The surfactant or surfactant admixture of the present invention can be selected from water soluble or water dispersible nonionic, semi-polar nonionic, anionic, cationic, amphoteric, or zwitterionic surface-active agents; or any combination thereof. The particular surfactant or surfactant mixture chosen for use in the process and products of this invention can depend on the conditions of final utility, including method of manufacture, physical product form, use pH, use temperature, foam control, and soil type.

A preferred surfactant system of the invention can be selected from amphoteric species of surface-active agents, which offer diverse and comprehensive commercial selection, low price; and, most important, excellent detersive effect—meaning surface wetting, soil penetration, soil removal from the surface being cleaned, and soil suspension in the detergent solution. Despite this preference the present composition can include one or more of nonionic surfactants, anionic surfactants, cationic surfactants, the sub-class of nonionic entitled semi-polar nonionics, or those surface-active agents which are characterized by persistent cationic and anionic double ion behavior, thus differing from classical amphoteric, and which are classified as zwitterionic surfactants.

Generally, the concentration of surfactant or surfactant mixture useful in compositions or methods of the present invention fall in the range of from about 0.5% to about 40% by weight of the composition, preferably about 2 to about 15 wt-%. These percentages can refer to percentages of the commercially available surfactant composition, which can contain solvents, dyes, odorants, and the like in addition to the actual surfactant. In this case, the percentage of the actual surfactant chemical can be less than the percentages listed. These percentages can refer to the percentage of the actual surfactant chemical.

Preferred surfactants for the compositions of the invention include non or low foaming surfactants including amphoteric surfactants, such as dicarboxylic coconut derivative sodium salts, and nonionic surfactants, such as alcohol ethoxylates and EO-PO block copolymers.

A typical listing of the classes and species of surfactants useful herein appears in U.S. Pat. No. 3,664,961 issued May 23, 1972, to Norris.

Nonionic Surfactant

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, isooctyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.
3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co.
4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application for specialized embodiments. All of these ester moieties have one or more reactive hydrogen sites on their molecule which can undergo further acylation or ethylene oxide (alkoxide) addition to control the hydrophilicity of these substances.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat No. 2,903,486 issued Sep. 8, 1959 to Brown et al. and represented by the formula

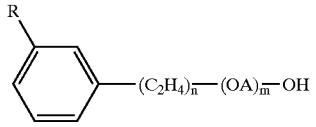

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued April 6, 1954 to Lundsted et al. having the formula $Y[(C_3H_6O_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R^2CONR^1Z$ in which: R1 is H, $C_1$–$C_4$ hydrocarbyl, 2-hydroxy ethyl, 2-hydroxy propyl, ethoxy, propoxy group, or a mixture thereof; $R_2$ is a $C_5$–$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$–$C_{18}$ fatty alcohols and $C_6$–$C_{18}$ mixed ethoxylated and propoxylated fatty alcohols are suitable surfactants for use in the present compositions, particularly those that are water soluble. Suitable ethoxylated fatty alcohols include the $C_{10}$–$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use the present compositions include those having the formula: $R^6CON(R^7)_2$ in which $R^6$ is an alkyl group containing from 7 to 21 carbon atoms and each $R^7$ is independently hydrogen, $C_1$–$C_4$ alkyl, $C_1$–$C_4$ hydroxyalkyl, or $—(C_2H_4O)_xH$, where x is in the range of from 1 to 3.

Preferred nonionic surfactants for the compositions of the invention include alcohol alkoxylates, EO/PO block copolymers, alkylphenol alkoxylates, and the like. The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in bottlewashing systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

13. Amine oxides are tertiary amine oxides corresponding to the general formula:

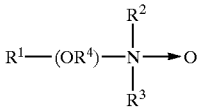

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1–3 carbon atoms or a mixture thereof, $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

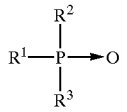

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis (hydroxymethyl)tetradecylphosphine oxide.

Semi-polar nonionic surfactants useful herein also include the water soluble sulfoxide compounds which have the structure:

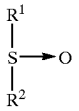

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Preferred semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As is well understood, anionics are excellent detersive surfactants and are therefore, favored additions to heavy duty detergent compositions. Generally, however, anionics have high foam profiles which limit their use alone or at high concentration levels in cleaning systems such as bottlewashers that require strict foam control. Anionics are very useful additives to preferred compositions of the present invention. Further, anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major known chemical classes and additional sub-groups, which are described in "Surfactant Encyclopedia", *Cosmetics & Toiletries*, Vol. 104 (2) 71–86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$–$C_{17}$ acyl-N—($C_1$–$C_4$alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11–13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule. Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y—and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

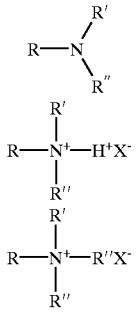

in which, R represents a long alkyl chain, R', R", and R'" may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four known major classes and additional sub-groups, which are described in "Surfactant Encyclopedia", *Cosmetics & Toiletries*, Vol. 104 (2) 86–96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

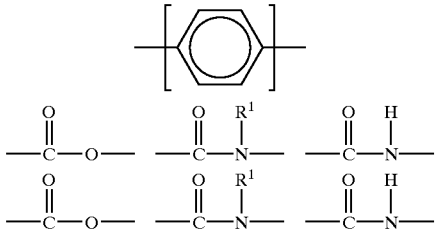

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y is can be a group including, but not limited to:

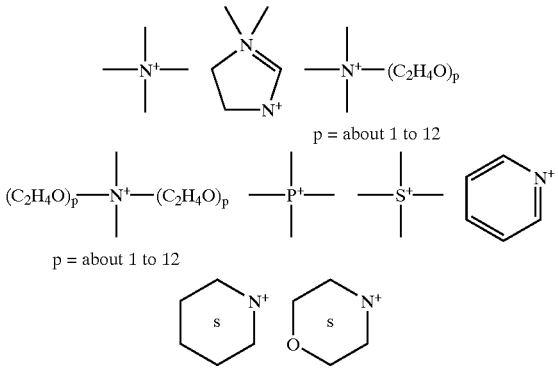

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphate, or phosphono. Amphoteric surfactants are subdivided into two known major classes, which are described in "Surfactant Encyclopedia" *Cosmetics & Toiletries*, Vol. 104 (2) 69–71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by known methods. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

(MONO)ACETATE

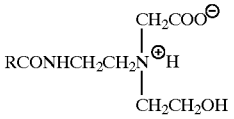

Neutral pH-Zwitterion (DI)PROPIONATE

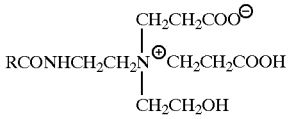

AMPHOTERIC SUFONATE

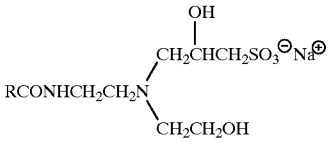

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which $R{=}C_8$–$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these R is preferably an acyclic hydrophobic group containing from about 8 to about 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from about 8 to 18 (preferably 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol™ C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

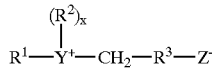

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3 -(N,N-dimethyl-N-hexadecylammonio)-propane-1-sulfonate; 3 -(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3 -[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

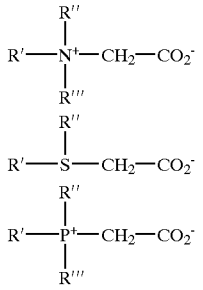

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4–$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$–$C_{18}$ hydrocarbyl group, each $R^1$ is typically independently $C_1$–$C_3$ alkyl, e.g. methyl, and $R^2$ is a $C_1$–$C_6$ hydrocarbyl group, e.g. a $C_1$–$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Surfactants

The surfactants described hereinabove can be used singly or in combination in the practice and utility of the present invention. In particular, the nonionics and anionics can be used in combination. The semi-polar nonionic, cationic, amphoteric and zwitterionic surfactants can be employed in combination with nonionics or anionics. The above examples are merely specific illustrations of the numerous surfactants which can find application within the scope of this invention. The foregoing organic surfactant compounds can be formulated into any of the several commercially desirable composition forms of this invention having disclosed utility. Said compositions are washing or presoak treatments for food or other soiled surfaces in concentrated form which, when dispensed or dissolved in water, properly diluted by a proportionating device, and delivered to the target surfaces as a solution, gel or foam will provide cleaning. Said cleaning treatments consisting of one product; or, involving a two product system wherein proportions of each are utilized. Said product is typically a concentrate of liquid or emulsion.

Additional Ingredients

The additive composition of the invention can also include any number of additional ingredients. Specifically, the composition of the invention can include stabilizing agents, wetting agents, hydrotropes as well as pigments or dyes among any number of constituents which can be added to the composition. Such additional ingredients can be preformulated with the additive composition of the invention or added to the system simultaneously, or even after, the addition of the additive composition. The composition of the invention can also contain any number of other constituents as necessitated by the application, which are known and which can facilitate the activity of the present invention.

Stabilizing Agents

Chelating agents or sequestrants generally useful as stabilizing agents in the present compositions include acrylic and polyacrylic acid-type stabilizing agents, phosphonic acid, and phosphonate-type chelating agents among others. Preferred phosphate, polyphosphate, phosphonic acid, and other phosphonate sequestrants and chelating agents are described hereinabove. The chelating agent or sequestering agent can effectively complex and remove undesired ions from inappropriate interaction with active ingredients thus increasing cleaning agent performance. Both organic and inorganic chelating agents may be used. Inorganic phosphate and phosphonate chelating agents are described hereinabove. Organic chelating agents include both polymeric and small molecule chelating agents. Polymeric chelating agents commonly include polyanionic compositions such as polyacrylic acid compounds. The concentration of chelating agent useful in the present invention generally ranges from about 0.01 to about 20 wt-%, preferably from about 0.1 to about 10 wt-%, most preferably from about 0.5 to about 5 wt-%.

Wetting or Defoaming Agents

Also useful in the composition of the invention are wetting and defoaming agents. Wetting agents function to increase the penetration activity of the additive composition of the invention. Wetting agents which can be used in the composition of the invention include any of those constituents known to raise the surface activity of the composition of the invention.

Along these lines surfactants, and especially nonionic surfactants, can also be useful in the present invention. Nonionic surfactants which can be useful in the present invention are those which include ethylene oxide moieties, propylene oxide moieties, as well a mixtures thereof, and ethylene oxide-propylene oxide moieties in either heteric or block formation. Additionally useful in the present invention are nonionic surfactants which include an alkyl ethylene oxide compounds, alkyl propylene oxide compounds, as well as mixtures thereof, and alkyl ethylene oxide-propylene oxide compounds where the ethylene oxide propylene oxide moiety is either in heteric or block formation. Further useful in the present invention are nonionic surfactants having any mixture or combination of ethylene oxide-propylene oxide moieties linked to a alkyl chain where the ethylene oxide and propylene oxide moieties can be in any randomized or ordered pattern and of any specific length. Nonionic surfactants useful in the present invention can also include randomized sections of block and heteric ethylene oxide propylene oxide, or ethylene oxide-propylene oxide.

Generally, the concentration of nonionic surfactant used in a composition of the present invention can range from about 0 wt-% to about 20 wt-% of the composition.

The composition used in the methods of the invention can also contain additional ingredients as necessary to assist in defoaming.

Generally, defoamers which can be used in accordance with the invention include silica and silicones; aliphatic acids or esters; alcohols; sulfates or sulfonates; amines or amides; halogenated compounds such as fluorochlorohydrocarbons; vegetable oils, waxes, mineral oils as well as their sulfated derivatives; fatty acid soaps such as alkali, alkaline earth metal soaps; and phosphates and phosphate esters such as alkyl and alkaline diphosphates, and tributyl phosphates among others; and mixtures thereof.

Especially preferable, are those antifoaming agents or defoamers which are appropriate for the application of the method of the invention. To this end, one of the more effective antifoaming agents includes silicones. Silicones such as dimethyl silicone, glycol polysiloxane, methylphenol polysiloxane, trialkyl or tetralkyl silanes, hydrophobic silica defoamers and mixtures thereof can all be used in defoaming applications. Commercial defoamers commonly available include silicones such as Ardefoam® from Armour Industrial Chemical Company which is a silicone bound in an organic emulsion; Foam Kill® or Kresseo® available from Krusable Chemical Company which are silicone and non-silicone type defoamers as well as silicone esters; and Anti-Foam A® and DC-200 from Dow Coming Corporation which are both food grade type silicones among others. These defoamers can be present at a concentration range from about 0.01 wt-% to 5 wt-%, preferably from about 0.01 wt-% to 2 wt-%, and most preferably from about 0.01 wt-% to about 1 wt-%.

Hydrotrope

The additive composition of the invention or employed in the methods of the invention may also include a hydrotrope coupler or solubilizer. Such materials can be used to ensure that the composition remains phase stable and in a single highly active aqueous form. Such hydrotrope solubilizers or couplers can be used at compositions which maintain phase stability but do not result in unwanted compositional interaction.

Representative classes of hydrotrope solubilizers or coupling agents include an anionic surfactant such as an alkyl sulfate, an alkyl or alkane sulfonate, a linear alkyl benzene or naphthalene sulfonate, a secondary alkane sulfonate, alkyl ether sulfate or sulfonate, an alkyl phosphate or phosphonate, dialkyl sulfosuccinic acid ester, sugar esters (e.g., sorbitan esters) and a $C_{8-10}$ alkyl glucoside.

Preferred coupling agents for use in the rinse agents of the invention include n-octane sulfonate and aromatic sulfonates such as an alkyl benzene sulfonate (e.g., sodium xylene sulfonate or naphthalene sulfonate). Generally, any number of surfactants may be used consistent with the purpose of this constituent.

Anionic surfactants useful with the invention include alkyl carboxylates, linear alkylbenzene sulfonates, paraffin sulfonates and secondary n-alkane sulfonates, sulfosuccinate esters and sulfated linear alcohols.

Zwitterionic or amphoteric surfactants useful with the invention include beta-N-alkylaminopropionic acids, n-alkyl-beta-iminodipropionic acids, imidazoline carboxylates, n-alky-Iletaines, amine oxides, sulfobetaines and sultaines.

Nonionic surfactants useful in the context of this invention are generally polyether (also known as polyalkylene oxide, polyoxyalkylene or polyalkylene glycol) compounds. More particularly, the polyether compounds are generally polyoxypropylene or polyoxyethylene glycol compounds. Typically, the surfactants useful in the context of this invention are synthetic organic polyoxypropylene (PO)-polyoxyethylene (EO) block copolymers. These surfactants have a diblock polymer including an EO block and a PO block, a center block of polyoxypropylene units (PO), and having blocks of polyoxyethylene grated onto the polyoxypropylene unit or a center block of EO with attached PO blocks. Further, this surfactant can have further blocks of either polyoxyethylene or polyoxypropylene in the molecule. The average molecular weight of useful surfactants ranges from about 1000 to about 40,000 and the weight percent content of ethylene oxide ranges from about 10–80% by weight.

Also useful in the context of this invention are surfactants including alcohol alkoxylates having EO, PO and BO blocks. Straight chain primary aliphatic alcohol alkoxylates can be particularly useful as sheeting agents. Such alkoxylates are also available from several sources including BASF Wyandotte where they are known as "Plurafac" surfactants. A particular group of alcohol alkoxylates found to be useful are those having the general formula $R—(EO)_m—(PO)_n$ wherein m is an integer of about 2–10 and n is an integer from about 2–20. R can be any suitable radical such as a straight chain alkyl group having from about 6–20 carbon atoms.

Other useful nonionic surfactants of the invention include capped aliphatic alcohol alkoxylates. These end caps include but are not limited to methyl, ethyl, propyl, butyl, benzyl and chlorine. Preferably, such surfactants have a molecular weight of about 400 to 10,000. Other useful nonionic surfactants are alkylpolyglycosides.

Another useful nonionic surfactant of the invention is a fatty acid alkoxylate wherein the surfactant includes a fatty acid moiety with an ester group including a block of EO, a block of PO or a mixed block or heteric group. The molecular weights of such surfactants range from about 400 to about 10,000, a preferred surfactant has an EO content of about 30 to 50 wt-% and wherein the fatty acid moiety contains from about 8 to about 18 carbon atoms.

Similarly, alkyl phenol alkoxylates have also been found useful in the invention. Such surfactants can be made from an alkyl phenol moiety having an alkyl group with 4 to about 18 carbon atoms, can contain an ethylene oxide block, a propylene oxide block or a mixed ethylene oxide, propylene oxide block or heteric polymer moiety. Preferably such surfactants have a molecular weight of about 400 to about 10,000 and have from about 5 to about 20 units of ethylene oxide, propylene oxide or mixtures thereof.

The concentration of hydrotrope useful in the present invention generally ranges from about 0.1 to about 20 wt-%, preferably from about 0.5 to about 10 wt-%, most preferably from about 1 to about 4 wt-%.

Thickening or Gelling Agents

Thickeners useful in the present invention include those which do not leave contaminating residue on the surface of bottles or bottle washing apparatus. That is, preferred thickeners or gelling agents do not include components incompatible with glass bottles and the bottle washing apparatus.

Generally, thickeners which may be used in the present invention include natural gums such as xanthan gum. Also useful in the present invention are cellulosic polymers, such as carboxymethyl cellulose. Generally, the concentration of thickener employed in the present compositions or methods will be dictated by the desired viscosity within the final composition. However, as a general guideline, the viscosity of thickener within the present composition ranges from about 0.1 wt-% to about 1.5 wt-%, preferably from about 0.1 wt-% to about 1.0 wt-%, and most preferably from about 0.1 wt-% to about 0.5 wt-%.

Polyol

The bottle washing additive composition of the invention can also include a polyol. The polyol advantageously provides additional stability and hydrotrophic properties to the composition. Propylene glycol and sorbitol are preferred polyols.

Dyes/Odorants

Various dyes, odorants including perfumes, and other aesthetic enhancing agents may also be included in the bottle washing additive composition. The dye advantageously provides visibility of the product in a package, dispenser, and/or lines of the bottlewasher, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba- Geigy), and the like. A wide variety of dyes are suitable.

Fragrances or perfumes that may be included in the compositions include, for example, terpenoids such as citronellol, aldehydes such as amyl cinnamaldehyde, a jasmine such as C1S-jasmine or jasmal, vanillin, and the like.

The present invention may be better understood with reference to the following examples. These examples are intended to be representative of specific embodiments of the invention, and are not intended as limiting the scope of the invention.

EXAMPLES

Example 1

Formulas for Liquid Additive Compositions

TABLE 1

Additive formulas that failed to mitigate corrosion of a ceramic applied color label.

| Ingredient | Control #1 | Control #2 | Control #3 | Control #4 | Control #5 | Control #6 |
|---|---|---|---|---|---|---|
| Water | 67 | 67 | 79 | 79 | 51 | 66 |
| ATMP | 3 | 3 | | | 4 | |
| HEDP | | | 4 | 4 | | 4 |
| PBTC | | | 1 | 1 | 2 | 1 |
| Phosphoric Acid | 15 | 15 | 0 | 0 | 23 | 15 |
| Gluconic Acid | 5 | 5 | 8 | 8 | 5 | 7 |
| Lactic Acid | | | 4 | 4 | | 4 |
| Citric Acid | | | 6 | 6 | | 5 |
| Polyoxyethylene coco amine | 2 | 2 | | | 8 | |
| EO-PO block copolymer | 6 | 6 | | | 8 | |
| Alcohol ethoxylate | 2 | 2 | | | | |
| Phosphate: Phosphonate Ratio | 5 | 5 | 0 | 0 | 4.1 | 3.8 |
| ACL Label Attacked? | YES | YES | YES | YES | YES | YES |

Quantities are in wt %

Sodium carbonate was employed at 15,000 ppm (1.5 wt-%) and caustic soda at 25,000 ppm (2.5 wt-%) in the use cleaning composition created from the concentrate additive compositions described in Table 1. EDTA was added to the cleaning compositions for controls #2, #3, and #4 separately from the additive composition to yield concentrations of EDTA in the cleaning compositions of 533 ppm, 500 ppm, and 1000 ppm, respectively. The additive concentrate composition was diluted 1:400 to make the use composition. Control #7 exposed the applied color design to only caustic and carbonate, and the design was attacked. Control #8 exposed the applied color design to only water, and the design was not attacked. Control #15 exposed the applied color design to only caustic, and the design was attacked.

TABLE 2

Additive formulas that mitigated corrosion of a ceramic applied color label.

| Ingredient | Test #9 | Test #10 | Test #11 | Test #12 | Test #13 | Test #14 |
|---|---|---|---|---|---|---|
| Water | 73 | 73 | 63 | 73 | 65 | 79 |
| HEDP | 4 | 4 | 4 | 4 | 4 | 4 |
| PBTC | 1 | 1 | 1 | 1 | 1 | 1 |

TABLE 2-continued

Additive formulas that mitigated corrosion of a ceramic applied color label.

| Ingredient | Test #9 | Test #10 | Test #11 | Test #12 | Test #13 | Test #14 |
|---|---|---|---|---|---|---|
| Phosphoric Acid | 8 | 8 | | 8 | 8 | |
| Gluconic Acid | 7 | 7 | 5 | 7 | 7 | 8 |
| Lactic Acid | 4 | 4 | 4 | 4 | 4 | 4 |
| Citric Acid | 5 | 5 | 5 | 5 | 5 | 6 |
| Polyoxyethylene coco amine | | | 3 | | | |
| Butyl capped alcohol ethoxylate | | | 15 | | | |
| EO-PO block copolymer | | | | | 6 | |
| Alcohol ethoxylate | | | | | 2 | |
| Phosphate:Phosphonate Ratio | 1.9 | 1.9 | 0 | 1.9 | 1.9 | 0 |
| ACL Label Attack? | NO | NO | NO | NO | NO | NO |

Quantities are in wt %

Sodium carbonate was employed at 15,000 ppm (1.5 wt-%) and caustic soda at 25,000 ppm (2.5 wt-%) in the use cleaning composition created from the concentrate additive compositions described in Table 2. The additive concentrate composition was typically diluted 1:400 to make the use composition, and in test #12 was diluted 1:200.

For purposes of testing, the additive composition was mixed with a caustic composition with or without added carbonate to achieve conditions of carbonate concentrations typically found in a bottle washing use composition. Caustic soda, and other basic mixtures, absorb carbon dioxide from the atmosphere to achieve carbonate concentrations as large as about 1.5 wt-%.

Materials

The following materials present examples of materials suitable for preparing the compositions of the present invention. Dequest® 2000: Amino tri (methylene-phosphonic acid), 50% (Solutia Inc.). Dequest® 2010: 1-Hydroxyethylene-1,1-diphosphonic acid, 60% (Solutia Inc.). Bayhibit AM, 2-phosphono-1,2,4-butanetricarboxylic acid, 50% (Miles Mobay/Bayer). Phosphoric acid, 75% (Albright and Wilson, Monsanto, FMC). Gluconic acid, 50% (PMP Fermentation Products). Lactic Acid: 2-hydroxypropanoic acid, 80% (Archer Daniels Midland). Citric acid, anhydrous granular, 100%, (A. E. Stanley). BK 1057, Polyoxyethylene (12) cocoamine, 98–100% (Chemax). LT-104, Butyl-capped alcohol ethoxylate, 100% (Henkel.). Genepol® PN 30, EO-PO block copolymer (Hoechst Celanese). Plurafac® RA-40, linear alcohol ethoxylate (BASF). Tetra sodium EDTA, ethylene diamine tetra acetic acid-sodium salt, 100% pwd, 40% solution (BASF). Sodium carbonate, pwd various densities and particles sizes (North American Chemical). Sodium hydroxide, beads, 50% solution (Oxychem).

Example 2

Formula with the Inventive Mixture of Phosphate and Phosphonate Exhibits Reduced Corrosion of an Applied Color Label in Bottle Washing An additive composition according to the present invention was tested and quantitatively evaluated for its effect on applied ceramic labels on bottles.

Test Method

To be able to simulate conditions in a bottle washing apparatus, a simple laboratory soak test method was employed to duplicate the soaking portion of the bottle washing cycle. The testing for was done using virgin bottles with applied ceramic labels, all being the same type of bottle and label (Carib Beer bottles). The bottles (typically 3 bottles per wash or additive composition) were submerged in 4 liters of the solution being tested for 24 hours at 75° C. A solution of 0.25% Stabilon SF and 500 ppm EDTA represented conventional bottle washing compositions. A bottle not treated by submersion was employed as a control. After submersion, the test bottles were rinsed with warm tap water, followed by distilled water, and set aside to dry.

The appearance of the test and control labels were then quantitatively evaluated using a surface roughness method, statistical software in Image Pro-Plus, and a Nikon SMZ-U Stereo-microscope. A uniform light intensity was established using a double arm halogen light source by positioning each arm at approximately 0° and 180°, respectively. This insured a spatially non-biased color illumination, independent of light intensity. The bottle was then placed on the stereoscope stage at a set angle and position to ensure a standardized image collection. Uniform intensity was checked by applying a best fit equalization to the image; this then allowed for any non-uniform light patterns to be seen prior to data collection. Images were then collected using the SONY DXC-970MD digital camera in a 24 bit color format and images were converted to 8-bit gray scale images. From this format a monochromatic shade distribution could be analyzed with a histogram and line plot analysis.

Results

Figure 4:
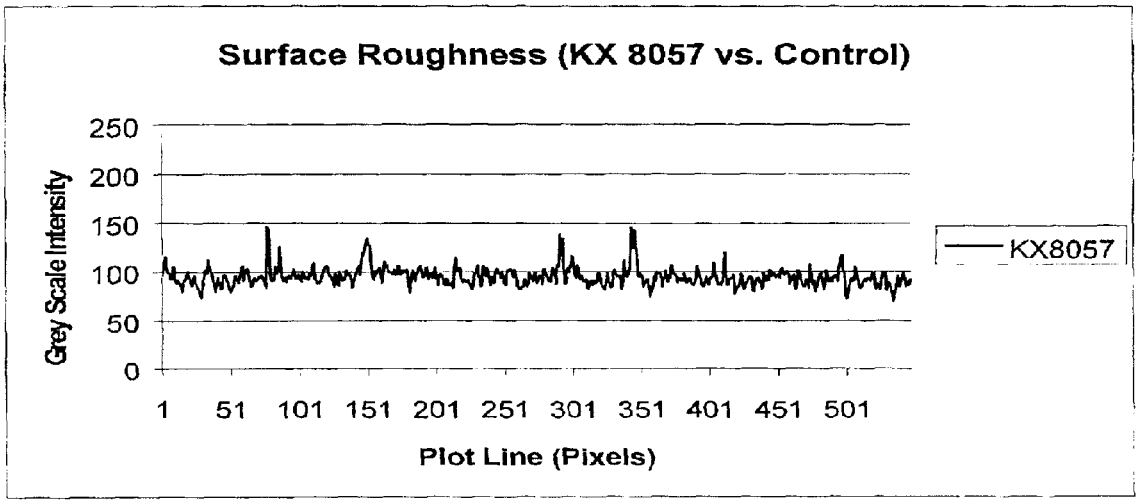
FIG. 4 illustrates the surface roughness for an applied color label of a bottle washed with a bottle wash composition of the present invention compared to a control bottle.

The analysis of unwashed, new control applied color labels, labels treated with an additive composition according to the present invention, and labels treated with a conventional bottle washing composition are illustrated in FIGS. 2–4 and Table 3. The data represent values of and variation in intensity of color in the label.

TABLE 3

Grey scale intensity, standard deviation, and range for unwashed control labels, labels treated with an additive composition of the present invention, and a conventional bottle washing composition.

| Measurement | Control | Inventive Additive Composition | Conventional Bottle Washing Composition |
|---|---|---|---|
| Mean | 97.91 | 95.01 | 147.61 |
| Standard Deviation | 8.74 | 9.72 | 18.81 |
| Range, Minimum–Maximum | 83–174 | 71–146 | 89–223 |

The analysis of the applied color label treated with the conventional washing composition, 0.25% Stabilion SF with 500 ppm EDTA, showed a significant change in color intensity compared to the control (FIG. 2, Table 3). The control sample, an untreated surface, had an average intensity level of 97.91 with a standard deviation of 8.74 (on a scale of 256 levels of gray). The conventional washing composition averaged a 147.61 intensity level with a standard deviation of 16.16. This shift to a higher value on the gray scale spectrum indicates a bleaching of the label, since 255 is equivalent to a completely white background, and zero represents a completely black background. In addition to the peak shift, the distribution found after treatment with the conventional washing composition was significantly broadened, with a range (2 standard deviations) of 115 to 180. This 64 unit range is an indication of greater variation of the label material caused by the conventional wash composition, which is consistent with bleaching and degradation of the label. As seen in FIG. 2, the untreated, control label showed a narrow distribution (36 intensity unit range), as well as a higher average frequency, which correlates with the low level of visible bleaching in the sample.

The inventive additive composition resulted in applied color labels having quality similar to that of the untreated, new control label. As seen in FIG. 2 and Table 3, like the control label, the label treated with the inventive composition showed a narrow distribution (36 intensity unit range), as well as a higher average frequency. Both of these values correlate with the low level of visible bleaching in the label treated with the inventive composition.

Analysis of surface roughness was performed using a component of the Image Pro Plus analysis software that obtains a plot based on the intensity values of a single line within an image. The intensity of each pixel is then related to surface roughness based on the intensity of each neighboring pixel. The range of intensity values thus determines the degree in change over the entire line with the standard deviation a relative measure of how widely values are dispersed from the average value. For this analysis, the assumption was made that the spatial variation is primarily a result of the roughness of the surface. Therefore, the line standard deviation can be used as a relative measure of the surface roughness.

Such an analysis is illustrated in FIGS. 3 and 4. These line graphs represent the surface roughness as a measurement of intensity. From the data illustrated in FIG. 3, the min/max intensity values for the conventional washing composition are 89–223 with an absolute value of 134. When compared to the control bottle, which scored a min/max of 83–174 and a absolute value of 91, treatment with the conventional composition yields a label that is 32% rougher than the new, untreated, control label. In contrast, the inventive additive composition yields a label that is smoother than the control label. FIG. 4 illustrates that using the inventive additive achieved a min/max of 71–146 and absolute value of 75. That is, using the inventive additive results in a surface that is 18% smoother than the control.

In addition to the range of surface roughness, the specific variance in the line is also shown in FIGS. 3 and 4. The specific variance also indicates a more severe level of surface roughness caused by the conventional bottle washing composition, which exhibits a standard deviation of 18.81. The control, untreated label and the label treated with the inventive additive composition yielded standard deviations of 8.74 and 9.72, respectively. The control and inventive additive labels had standard deviations less than half caused by treatment with the conventional washing composition.

Conclusions

The results demonstrated that the additive composition of the present invention did not have a detrimental impact of an applied color label. A correlation was observed between both visible color deterioration seen in the sample and the control. A correlation was also observed that indicated that an increase in color stability, which was reflected in a more non-variant surface (smooth) based on a decreased color variance. In contrast, a conventional bottle washing composition caused both a change in color intensity, which indicated bleaching or whiting of the label, as well as an increase in surface intensity variance, which again is indicative of a non-uniform surface.

Example 3

Phosphate Containing Additive Compositions Reduce Glass Corrosion

TABLE 4

Phosphate-free additive formulas used as controls in this Example.

| Ingredient | Control #16 | Control #17 | Control #18 | Control #19 | Control #20 | Control #21 |
|---|---|---|---|---|---|---|
| Water | 73 | 53 | 90 | 95 | 98 | 99 |
| Potassium Iodide | 0.3 | 0.3 | | | | |
| HEDP (60%) | 10 | 10 | 1 | 0.5 | 0.25 | 0.13 |
| PBTC (50%) | 1.5 | 1.5 | 1 | 0.5 | 0.25 | 0.13 |
| ATMP (50%) | | 20 | | | | |
| Gluconic Acid (50%) | 15 | 15 | 8 | 4 | 2 | 1 |
| Phosphoric Acid | 0 | 0 | 0 | 0 | 0 | 0 |
| Phosphate: Phosphonate Ratio | 0 | 0 | 0 | 0 | 0 | 0 |
| Glass Corroded? | No | No | No | No | No | No |

Quantities are in wt %.

TABLE 5

Phosphate containing additive formulas that mitigated corrosion of a ceramic applied color label and cleaned the bottle.

| Ingredient | Test #22 | Test #23 | Test #24 | Test #25 | Test #26 |
|---|---|---|---|---|---|
| Water | 56 | 45 | 94 | 97 | 98 |
| Potassium Iodide | 0.3 | 0.3 | | | |
| HEDP (60%) | 10 | 10 | 0.5 | 0.25 | 0.13 |
| PBTC (50%) | 1.5 | 1.5 | 0.5 | 0.25 | 0.13 |
| ATMP (50%) | | 17 | | | |
| Gluconic Acid (50%) | 15 | 15 | 4 | 2 | 1 |

TABLE 5-continued

Phosphate containing additive formulas that mitigated corrosion of a ceramic applied color label and cleaned the bottle.

| Ingredient | Test #22 | Test #23 | Test #24 | Test #25 | Test #26 |
|---|---|---|---|---|---|
| Phosphoric Acid (75%) | 18 | 12 | 1.5 | 0.7 | 0.4 |
| Phosphate:Phosphonate Ratio | 2:1 | 0.6:1 | 2:1 | 2:1 | 2:1 |
| Glass Corroded? | No | No | No | No | No |

Quantities are in wt %.

Methods

| Glass Corrosion Testing | |
|---|---|
| For glass corrosion testing the bottle washing compositions were made up as: | |
| 0.25% Bottle Wash Additive | 9.5 g |
| 1.50% $Na_2CO_3$ | 57.0 g |
| 5% of 50% NaOH Solution | 195.0 |
| Tap Water | 3543.5 g |
| Total | 3800 g |

The bottle washing composition was prepared in a 4 liter stainless steel beaker. The beaker was covered with two layers of plastic wrap secured with binders. The beakers were preheated in a 75° C. oven.

Two glass bottles were selected and coded for each control or test composition. The bottles were rinsed with DI water and placed in <122° F. oven to dry for several hours or overnight, then they were removed and cooled. The bottles were weighed to the nearest tenth of a milligram and the weight recorded.

The marked bottles were placed in their respective preheated bottle wash composition. The plastic wrap was recovered and secured with binders. The beakers were placed back into the 75° C. oven and leave for 24 hours. At the end of 24 hours, the beakers were removed from the oven and cooled for 1.5 hours. The bottles were then removed from the wash compositions and rinsed with warm tap water. The bottles were placed into 1% phosphoric acid solution for 0.5 hours to remove residues. The bottles were removed from the phosphoric acid, rinsed with DI water, and dried in a <122° F. oven. On the next day, the bottles were removed from the oven to cool. When cooled, the bottles were weighed to the nearest tenth of a milligram and this post-treatment weight was recorded.

The % weight loss for the bottle was determined from the equation: (Original Bottle Wt−Final Bottle Wt)/Original Bottle Wt*100.

| Cleaning Efficacy Testing | |
|---|---|
| For cleaning efficiency testing the bottle washing compositions were made up as: | |
| 0.25% Bottle Wash Additive | 9.5 g |
| 1.50% $Na_2CO_3$ | 57.0 g |
| 5% of 50% NaOH Solution | 195.0 |
| Tap Water | 3543.5 g |
| Total | 3800 g |

The bottle washing composition was prepared in a 4 liter stainless steel beaker. The beakers were preheated in a 75° C. oven with stirring.

Two glass bottles were selected and coded for each control or test composition. Bottles were obtained from a local bottler and were soiled with a clay and dirt. Soiled bottles were sorted and those with similar soiling were grouped together and used as pairs.

When the cleaning compositions reached 75° C., the two selected (coded) bottles were placed into their respective solutions and allowed to soak for 10 minutes. The composition was mildly stirred to dissipate heat from bottom of beaker. After 10 minutes, the bottles were removed from the composition and rinsed with light to medium flow of lukewarm water for 20 seconds.

The bottles were then allowed to air dry and then visually rated for cleanliness against each other. The visual rating scale ranked the bottles from 1 to 10. The bottles had been photographed before washing, and the washed bottles were compared to the photographs of the unwashed bottles. A control bottle washed with a caustic wash composition without additive typically had about 80% of the total mass of soil removed. Such a bottle generally was rated 2 or 3 on the visual ranking scale. A bottle that had had some 98% of the mass of soil removed typically ranked 8 or 9 on the visual ranking scale. A bottle with about 90% of the mass of soil removed typically rated about a 5 on the visual ranking scale. The visible ranking scale has proven reproducible and useful for determining bottle cleanliness.

Results

Phosphate-containing compositions according to the present invention had some cleaning activity and, surprisingly, reduced corrosion of the glass (Table 6). Also surprising, the control compositions lacking phosphate cleaned more effectively than the test compositions. The control compositions lacking phosphate also reduced corrosion of the glass (Table 6).

TABLE 6

Phosphate containing compositions according to the present invention clean with only acceptable levels of glass corrosion.

| Composition | Average Percent Weight Loss | Average Cleaning Grade (maximum is 10) |
|---|---|---|
| Control #16 | 0.0030 | 5 |
| Control #17 | 0.0384 | 6 |
| Test #22 | 0.0557 | 2 |
| Test #23 | 0.0188 | 3 |

Figure 5:
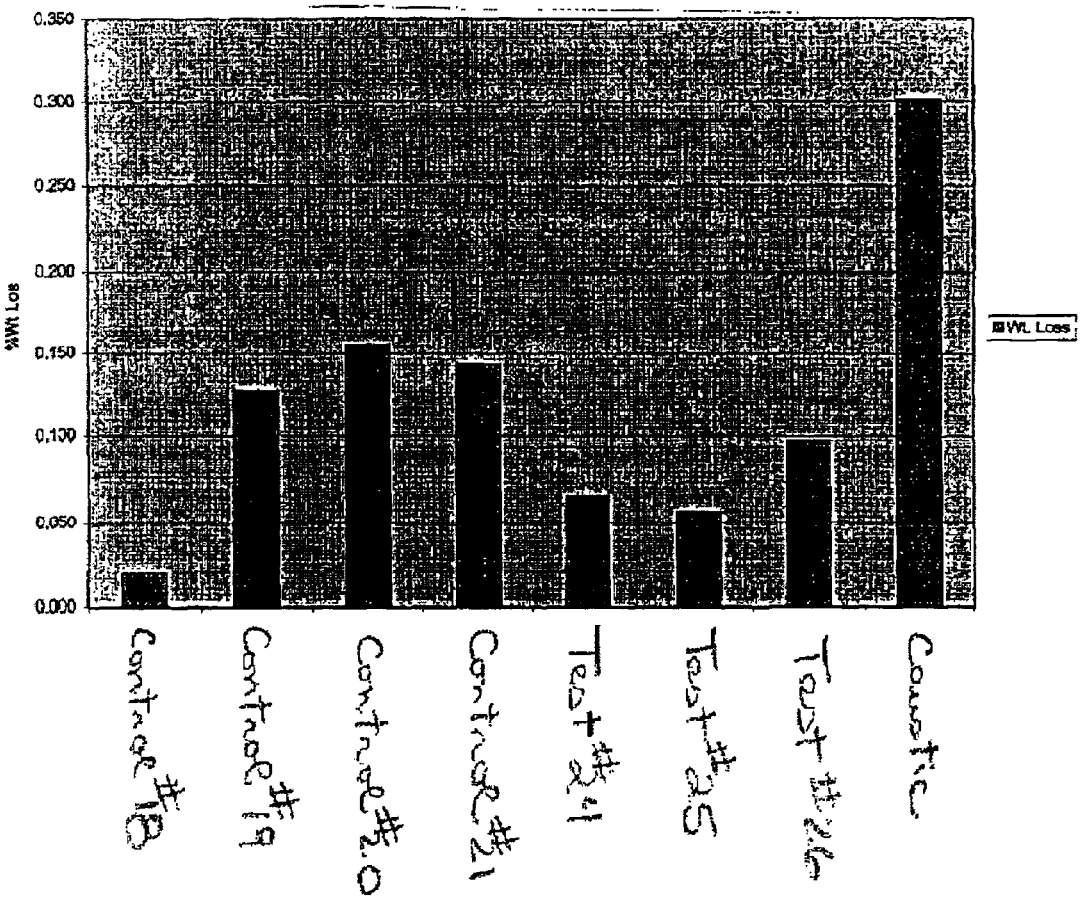
FIG. 5 illustrates reduced glass corrosion by phosphate-containing compositions according to the present invention.

Another study evaluated glass corrosion by control compositions #18–21 and test compositions #24–26. These results are illustrated in FIG. 5. Bottle washing with caustic and no additive caused by far the greatest loss of mass of glass. Control #18 caused the greatest reduction in glass corrosion. Controls #19, #20, and #21 caused intermediate reductions in glass corrosion. Surprisingly, adding an agent known to cause corrosion of glass, phosphoric acid, to the additive resulted a greater reduction in glass corrosion; compare controls #19–21 to tests #24–26 (FIG. 5).

Conclusions

The phosphate-containing compositions according to the present invention reduce glass corrosion. Surprisingly, control compositions lacking phosphate exhibited greater cleaning and also reduced glass corrosion.

Example 4

Phosphate-Free Formulas of Liquid Additive Compositions Reduce Glass Corrosion

TABLE 7

Control phosphate-free additive formulas that reduce glass corrosion but clean only poorly, and test formulas that reduce glass corrosion and clean.

| Ingredient | Control #27 | Control #28 | Test #29 | Test #30 |
|---|---|---|---|---|
| Water | 67 | 54 | 53 | 35 |
| Potassium Iodide | 0.25 | 0.25 | 0.3 | 0.3 |
| HEDP (60%) | 6.5 | 6.5 | 10 | 10 |
| PBTC (50%) | 1 | 1 | 1.5 | 1.5 |
| ATMP (50%) | 0 | 0 | 20 | 20 |
| Gluconic Acid (50%) | 15 | 10 | 15 | 15 |
| Citric Acid Monohydrate | 5.5 | 5.5 | 0 | 0 |
| Lactic Acid | 5 | 5 | 0 | 0 |
| Polyoxyethylene coco amine | 0 | 3 | 0 | 3 |
| Alcohol ethoxylate | 0 | 15 | 0 | 15 |
| Glass Corroded? | No | No | No | No |
| Bottle Cleaned | No | No | Yes | Yes |

Quantities are in wt-%.

TABLE 8

Additional phosphate containing compositions that mitigate glass corrosion.

| Ingredient | Control #31 | Test #32 | Test #33 | Test #34 | Test #35 |
|---|---|---|---|---|---|
| Water | 67 | 22 | 39 | 32 | 29 |
| Potassium Iodide | 0.25 | 0.25 | 0.25 | 0.25 | 0.25 |
| HEDP (60%) | 6.5 | 0 | 6.5 | 9.9 | 9.9 |
| PBTC (50%) | 1 | 0 | 1 | 1.5 | 1.5 |
| ATMP (50%) | 0 | 26 | 26 | 26 | 13 |
| Phosphoric Acid | 0 | 17 | 12 | 5.5 | 12 |
| Gluconic Acid (50%) | 48 | 15 | 15 | 15 | 15 |
| Citric Acid Monohydrate | 5.5 | 10 | 0 | 5 | 10 |
| Lactic Acid | 4.6 | 9.2 | 0 | 4.6 | 9.2 |
| Phosphate:Phosphonate Ratio | 0 | — | 2:1 | 1:1 | 1.3:1 |
| Glass Corroded? | No | Yes | No | No | No |
| Bottle Cleaned | No | Yes | Yes | Yes | Yes |

Quantities are in wt %.

Methods

Glass corrosion and cleaning efficacy were tested by the methods described in Example 3.

Results

The phosphate-free compositions according to the present invention cleaned the bottles with high scores on the visual rating test and reduced corrosion of the glass. In contrast, control compositions with lower levels of phosphonate neither cleaned nor corroded the glass. These results are shown in Table 9. Surprisingly, the control compositions did not clean the bottles even at the levels of phosphonate they employ.

TABLE 9

Amino phosphonate containing compositions according to the present invention clean without unacceptably corroding glass.

| Composition | Average Percent Weight Loss | Average Cleaning Grade (maximum is 10) |
|---|---|---|
| Control #27 | 0.0056 | 1 |
| Control #28 | 0.0048 | 0.5 |
| Test #29 | 0.0384 | 6 |
| Test #30 | 0.0396 | 7 |

TABLE 10

Compositions containing phosphate and amino phosphonate mitigate glass corrosion

| Composition | Average Percent Weight Loss |
|---|---|
| Control #31 | 0.0021 |
| Test #32 | 0.23 |
| Test #33 | 0.12 |
| Test #34 | 0.12 |
| Test #35 | 0.023 |

Conclusions

The amino phosphonate containing compositions according to the present invention mitigate glass corrosion and clean.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "adapted and configured" describes a system, apparatus, or other structure that is constructed or configured to perform a particular task or adopt a particular configuration to. The phrase "adapted and configured" can be used interchangeably with other similar phrases such as arranged and configured, constructed and arranged, adapted, constructed, manufactured and arranged, and the like.-

All publications and patent applications in this specification are indicative of the level of ordinary skill in the art to which this invention pertains.

The invention has been described with reference to various specific and preferred embodiments and techniques. However, it should be understood that many variations and modifications may be made while remaining within the spirit and scope of the invention.

We claim:

1. A concentrate composition comprising phosphate and phosphonate, the phosphate and the phosphonate being present in a ratio by weight of about 0.5:1 to about 3:1; the concentrate being adapted and configured for washing of glass or ceramic ware with an applied colored design.

2. The concentrate composition of claim 1, further comprising an organic builder.

3. The concentrate composition of claim 2, wherein the organic builder comprises a 2 to 12 carbon mono or di carboxylic acid.

4. The concentrate composition of claim 3, wherein the 2 to 12 carbon mono or di carboxylic acid comprises a gluconic acid, a citric acid, a lactic acid or a combination thereof.

5. The concentrate composition of claim 1, wherein the phosphate and phosphonate are in a weight ratio of about 1.9:1.

6. The concentrate composition of claim 1, wherein the phosphate comprises a monomer of phosphoric acid, a polymer of phosphoric acid, a salt of phosphoric acid, or a combination thereof.

7. The concentrate composition of claim 6, wherein the phosphate comprises an ortho phosphate, a meta phosphate, a tripolyphosphate, or a combination thereof.

8. The concentrate composition of claim 6, wherein the phosphate comprises phosphoric acid.

9. The concentrate composition of claim 1, wherein the phosphonate comprises organic phosphonate, amino phosphonate, or a combination thereof.

10. The concentrate composition of claim 9, wherein the organic phosphonate comprises 1-hydroxyethylidene-1,1-diphosphonic acid (HEDP); 2-phosphonobutane-1,2,4-tricarboxylic (PBTC); or a combination thereof.

11. The concentrate composition of claim 1, further comprising an organic builder, wherein the organic builder comprises a gluconic acid, a citric acid, a lactic acid or a combination thereof; the phosphate comprises phosphoric acid; and the phosphonate comprises 1-hydroxyethylidene-1,1-diphosphonic acid (HEDP); amino(tri (methylenephosphonic acid)) (ATMP); 2-phosphonobutane-1,2,4-tricarboxylic (PBTC); or a combination thereof.

12. The concentrate composition of claim 11, comprising about 8 wt-% gluconic acid, about 5 wt-% citric acid, about 5 wt-% lactic acid, about 10 wt-% phosphoric acid, about 6 wt-% HEDP, and about 1 wt-% PBTC, the remainder being water or another carrier.

13. The concentrate composition of claim 11, comprising about 16 wt-% gluconic acid, about 10 wt-% citric acid, about 10 wt-% lactic acid, about 20 wt-% phosphoric acid, about 12 wt-% HEDP, and about 2 wt-% PBTC, the remainder being water or another carrier.

14. The concentrate composition of claim 1, wherein the composition is substantially free of EDTA.

15. The concentrate composition of claim 1, further comprising a source of alkalinity, a surfactant, or a combination thereof.

16. The concentrate composition of claim 15, wherein the source of alkalinity comprises sodium hydroxide, a carbonate, or a combination thereof.

17. The concentrate composition of claim 15, wherein the surfactant comprises an amphoteric surfactant, a nonionic surfactant, or a combination thereof.

18. The concentrate composition of claim 17, wherein the amphoteric surfactant comprises a polyoxyethylene coco amine.

19. The concentrate composition of claim 17, wherein the nonionic surfactant comprises an alcohol ethoxylate or an EO-PO block copolymer.

20. A concentrate composition comprising phosphate; phosphonate; and source of alkalinity, surfactant, or combination thereof; the phosphate and the phosphonate being present in a ratio by weight of about 0.5:1 to about 3:1; the concentrate being adapted and configured for washing of glass or ceramic ware with an applied colored design.

21. The concentrate composition of claim 20, wherein the source of alkalinity comprises sodium hydroxide, a carbonate, or a combination thereof.

22. The concentrate composition of claim 20, wherein the surfactant comprises an amphoteric surfactant, a nonionic surfactant, or a combination thereof.

23. The concentrate composition of claim 22, wherein the amphoteric surfactant comprises a polyoxyethylene coco amine.

24. The concentrate composition of claim 22, wherein the nonionic surfactant comprises an alcohol ethoxylate or an EO-PO block copolymer.

25. The concentrate composition of claim 20, wherein the phosphate and phosphonate are in a weight ratio of about 1.9:1.

26. The concentrate composition of claim 20, wherein the phosphate comprises phosphoric acid.

27. The concentrate composition of claim 20, wherein the phosphonate comprises 1-hydroxyethylidene-1,1-diphosphonic acid (HEDP); amino(tri (methylenephosphonic acid)) (ATMP); 2-phosphonobutane-1,2,4-tricarboxylic (PBTC); or a combination thereof.

28. The concentrate composition of claim 20, further comprising an organic builder, wherein the organic builder comprises a gluconic acid, a citric acid, a lactic acid or a combination thereof; the phosphate comprises phosphoric acid; the phosphonate comprises 1-hydroxyethylidene-1,1-diphosphonic acid (HEDP), amino(tri (methylenephosphonic acid)) (ATMP); 2-phosphonobutane-1,2,4-tricarboxylic (PBTC), or a combination thereof; the surfactant comprises an alcohol ethoxylate, an EO-PO block copolymer, or a combination thereof; and the source of alkalinity comprises sodium hydroxide, a carbonate, or a combination thereof.

29. The concentrate composition of claim 20, wherein the composition is substantially free of EDTA.

30. A use composition comprising phosphate; phosphonate; and source of alkalinity, surfactant, or combination thereof; the phosphate and the phosphonate being present in a ratio by weight of about 0.5:1 to about 3:1; the use composition being adapted and configured for washing of glass or ceramic ware with an applied colored design.

31. The use composition of claim 30, wherein the source of alkalinity comprises sodium hydroxide, a carbonate, or a combination thereof.

32. The use composition of claim 30, wherein the surfactant comprises an amphoteric surfactant, a nonionic surfactant, or a combination thereof.

33. The use composition of claim 32, wherein the amphoteric surfactant comprises a polyoxyethylene coco amine.

34. The use composition of claim 32, wherein the nonionic surfactant comprises an alcohol ethoxylate or an EO-PO block copolymer.

35. The use composition of claim 30, wherein the phosphate and phosphonate are in a weight ratio of about 1.9:1.

36. The use composition of claim 30, wherein the phosphate comprises phosphoric acid.

37. The use composition of claim 30, wherein the phosphonate comprises 1-hydroxyethylidene-1,1-diphosphonic acid (HEDP); amino(tri(methylenephosphonic acid)) (ATMP); 2-phosphonobutane-1,2,4-tricarboxylic (PBTC); or a combination thereof.

38. The use composition of claim 30, further comprising an organic builder, wherein the organic builder comprises a gluconic acid, a citric acid, a lactic acid or a combination thereof; the phosphate comprises phosphoric acid; the phosphonate comprises 1-hydroxyethylidene-1,1-diphosphonic acid (HEDP), amino(tri(methylenephosphonic acid)) (ATMP); 2-phosphonobutane-1,2,4-tricarboxylic (PBTC), or a combination thereof; the surfactant comprises an alcohol ethoxylate, an EO-PO block copolymer, or a combination thereof; and the source of alkalinity comprises sodium hydroxide, a carbonate, or a combination thereof.

39. The use composition of claim 30, wherein the composition is substantially free of EDTA.

* * * * *